United States Patent [19]

Logue

[11] Patent Number: 4,573,639

[45] Date of Patent: Mar. 4, 1986

[54] SHOWER HEAD

[76] Inventor: Murl F. Logue, 29435 Sanches Rd., Newman, Calif. 95360

[21] Appl. No.: 741,816

[22] Filed: Jun. 6, 1985

Related U.S. Application Data

[63] Continuation of Ser. No. 466,424, Feb. 15, 1983, abandoned, which is a continuation-in-part of Ser. No. 381,190, May 24, 1982, abandoned.

[51] Int. Cl.[4] ..... E03C 1/08

[52] U.S. Cl. ..... 239/428.5; 239/569; 239/590.3

[58] Field of Search ..... 239/428.5, 590.3, 533.3, 239/569, 310, 318, 589, DIG. 18

[56] References Cited

U.S. PATENT DOCUMENTS

| | | | |
|---|---|---|---|
| 159,142 | 1/1875 | Baird | 239/428.5 X |
| 578,948 | 3/1897 | Schaffstaett | 239/428.5 |
| 1,976,062 | 10/1934 | Estep | 239/428.5 X |
| 2,069,733 | 2/1937 | Zinkil | 239/DIG. 18 |
| 2,136,135 | 4/1943 | Turek et al. | 239/428.5 X |
| 2,965,313 | 12/1960 | Jay | 239/569 |
| 4,072,270 | 2/1978 | Harmony | 239/428.5 |
| 4,426,040 | 1/1984 | Smith | 239/428.5 |

*Primary Examiner*—Jeffrey V. Nase

[57] ABSTRACT

An aerating shower head is provided wherein the discharge rate is very low yet gives the user the illusion and feeling that he is showering with a full flow of water. In accordance with one embodiment, the head is provided with a valve, so that the pressure to the head can be reduced or even shut off.

5 Claims, 6 Drawing Figures

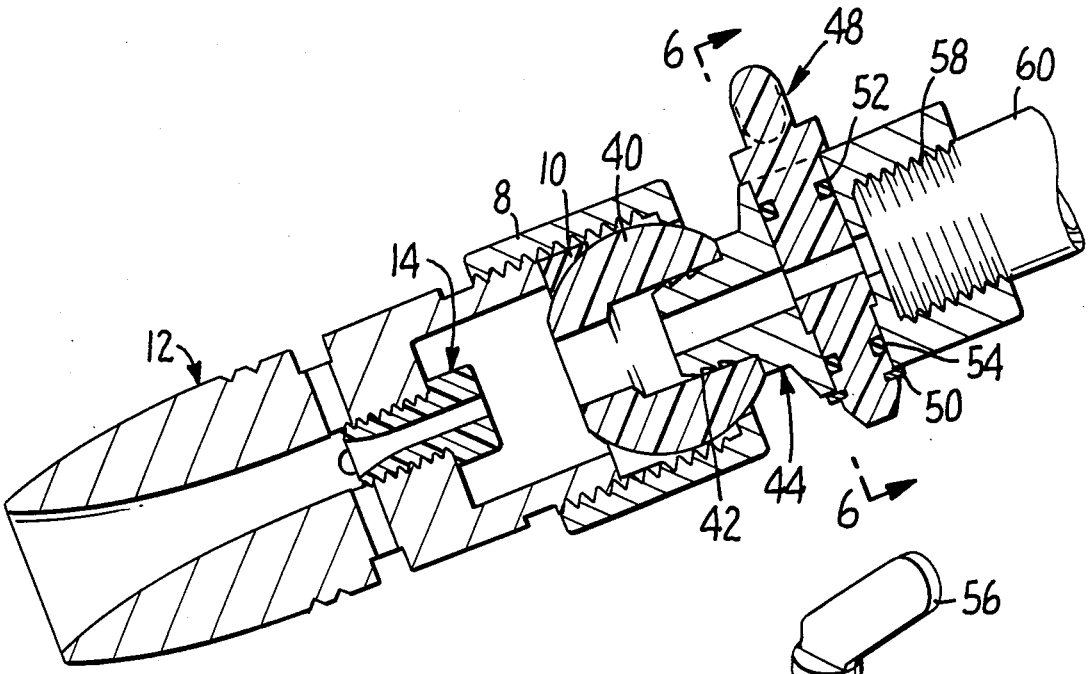
FIG. 4.
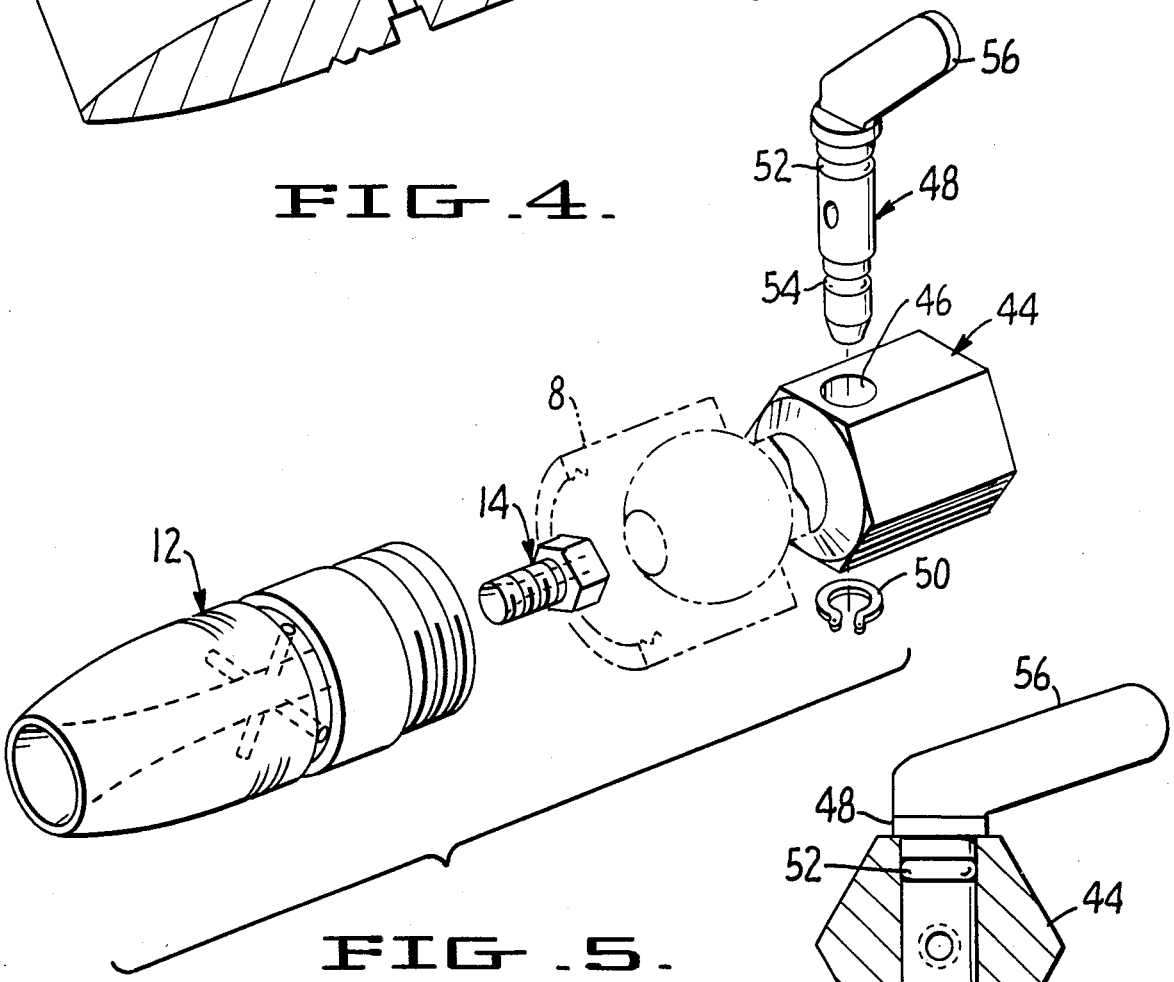
FIG. 5.
FIG. 6.

SHOWER HEAD

REFERENCE TO RELATED APPLICATION

This application is a continuation of application Ser. No. 466,424, filed Feb. 15, 1983 and entitled SHOWER HEAD, now abandoned, that application is a continuation-in-part of application Ser. No. 381,190, filed May 24, 1982, now abandoned.

SUMMARY OF THE INVENTION

At the present time most consumers are aware of high energy costs and wish to take steps to reduce energy consumption. Heating hot water constitutes a very substantial percentage of the total energy consumed in a home so that any reduction of hot water use makes an important contribution to energy conservation.

The present invention relates to an improved shower head wherein the flow can be reduced well beyond that of the normal shower head. Previously there have been attempts to reduce the flow of shower heads merely by placing restrictions at some point within the head but these have not proved popular because the user does not feel that he is getting a full flow of water. The aerating shower head of the present invention permits one to have a much lower flow of water yet gives the illusion that one has a full flow. Thus, prior art shower heads that are commonly used frequently use from 10 to 24 quarts of water per minute while the shower head of the present invention gives a very satisfactory shower when using six or less quarts per minute.

In achieving the results of the present invention, it has been found that the relationship of the various parts are critical and will be described in detail hereafter.

One feature of the present invention is the employment of a novel metering orifice which has a small cylindrical entrance section and a divergent section terminating in an enlarged outlet port which serves to not only meter the proper amount of water but also break up the stream of water just prior to the introduction of air which produces the proper spray pattern.

Another novel feature of the present invention is that in the preferred embodiment of the invention the metering orifice is fabricated as a separate replaceable part so that one can change the flow volume merely by replacing the orifice. Additionally, should the orifice clog up, it is easily replaceable.

Another feature of the present invention is that cylindrical passage is provided for the flow of aerated water within the nozzel which leads to a divergent section of substantially larger diameter. This configuration has also been found necessary to secure the proper flow of water.

The outer surface of the exit port of the nozzle is tapered so that the port itself includes an edge rounded on a small diameter. This provides a conical configuration which prevents any eddy currents from forming around the exit port and thus prevents dripping.

In many highrise buildings, excessively high water pressures may be encountered. If the nozzle of the present invention is subjected to a pressure which is too high, the purpose of the nozzle will be largely defeated. The problem is particularly severe with plumbing fixtures wherein the user merely turns the water on or off and regulates only the temperature and has no control over the flow rate. In one embodiment of the present invention, the improved shower head is provided with a user operated valve so that the pressure to the head can be reduced regardless of the line pressure. Thus, the head is allowed to function normally even under excessive pressure. Further, this embodiment of the invention permits the user to turn the water completely off at the head if this is desired. When the water supply is extremely limited, users are frequently instructed to first wet their bodies, turn the water off while soaping and then turn on the water for rinsing. The valve which is incorporated with this head makes this operation very convenient since it is easily accessible and does not disturb the hot-cold setting of the regular valve.

Various other features and advantages of the invention will be brought out in the balance of the specification.

BRIEF DESCRIPTION OF THE DRAWINGS

FIG. 4 is a side view in section of another embodiment of the invention which incorporates a valve.

FIG. 5 is an exploded, perspective view of the head and valve structure shown in FIG. 4.

FIG. 6 is a section on the line 6—6 of FIG. 4.

DESCRIPTION OF THE PREFERRED EMBODIMENTS

Figure 1:
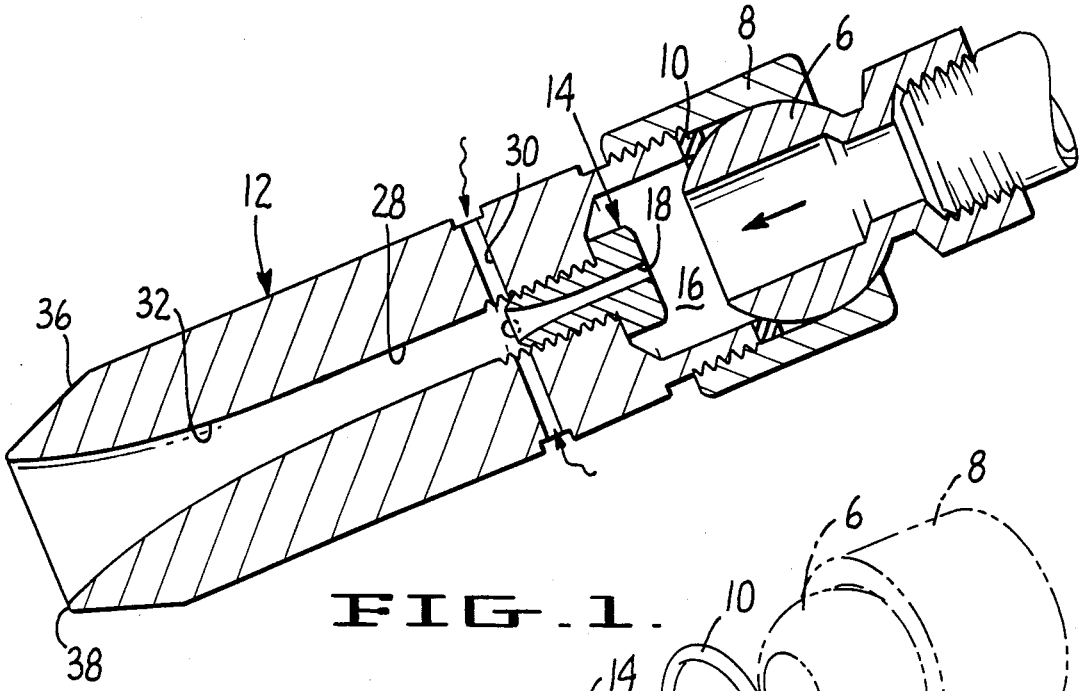
FIG. 1 is a side view in section of a shower head embodying the present invention.
Figure 2:
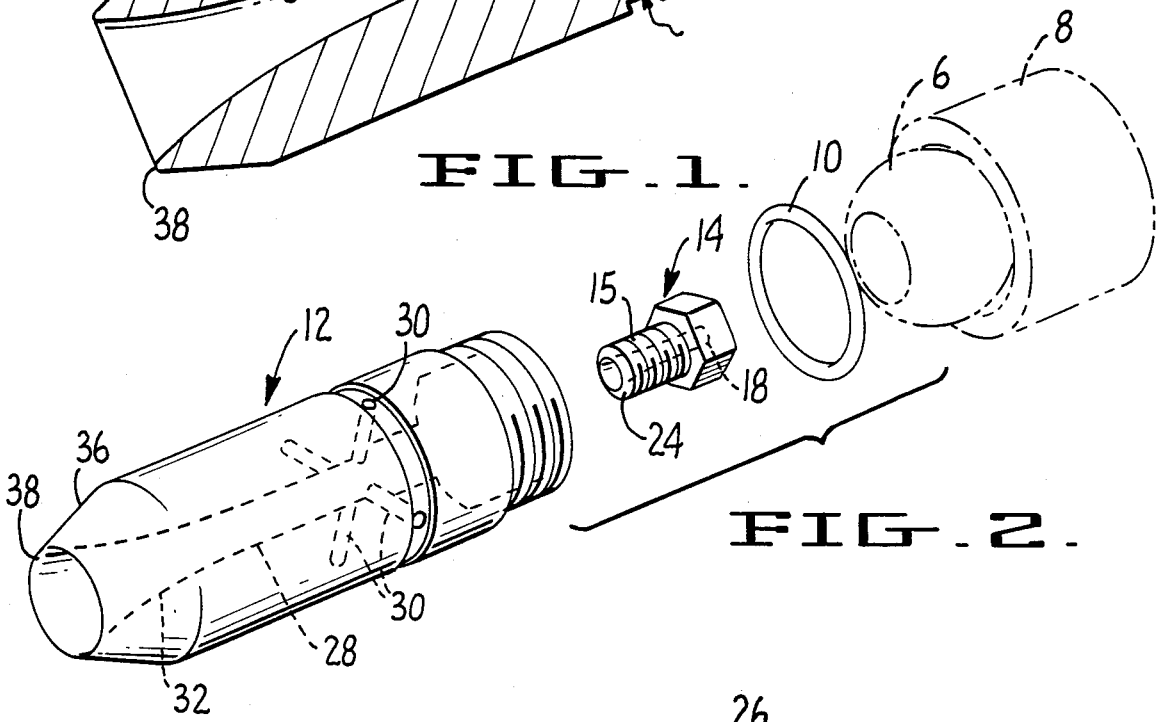
FIG. 2 is an exploded, perspective view of the shower head.
Figure 3:
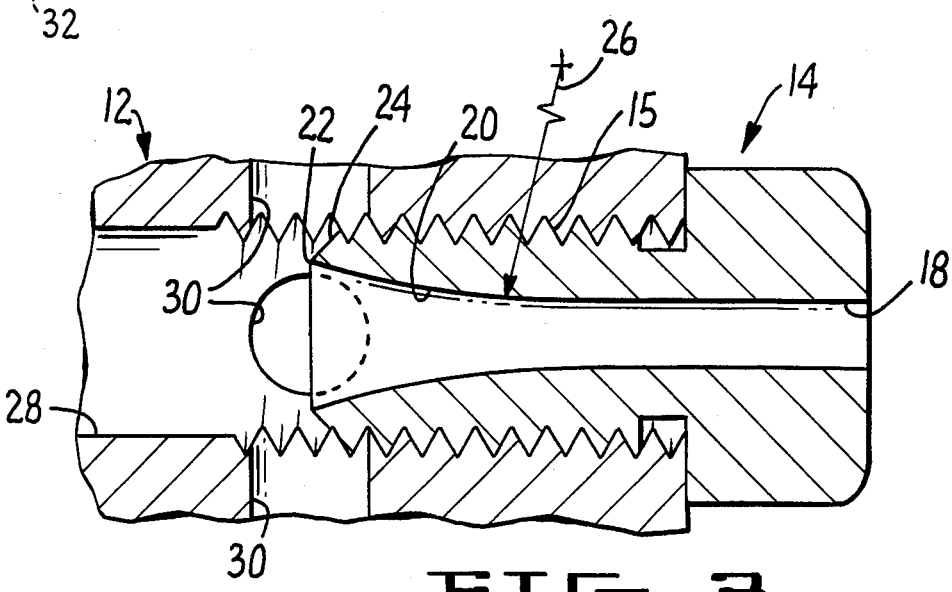
FIG. 3 is an enlarged view in section of the metering orifice and that portion of the nozzle wherein air is introduced.

In the embodiment of the invention shown in FIGS. 1–3, the shower head is shown installed on a standard ball 6 employed with conventional showers and held in place with a jamb nut 8 with a gasket 10 providing a seal. However, this portion of the shower head is conventional and the shower head of the present invention might be merely screwed or otherwise attached to an ordinary water outlet as is frequently done in institutions.

The shower head of the present invention consists of two main parts, namely a nozzle portion generally designated 12 and a metering orifice generally designated 14. In the embodiment of the invention illustrated, the metering orifice is threaded at 15 and screws into the nozzle as shown, although one could fabricate these parts in a single piece without departing from the spirit of this invention. It is preferred that the metering orifice be fabricated as a separate part for ease in manufacture and ease in replacement.

At the rear of the nozzle there is formed a relatively large chamber 16 and the metering orifice, which is of much smaller diameter than this chamber, draws water from chamber 16 through a cylindrical entrance section 18 and then through a gently flared divergent section 20 to an exit or outlet port 22 which is much larger in diameter than the cylindrical entrance 18. The length of the cylindrical entrance portion 18 is not critical but its diameter must be proportioned to the divergent section. In addition, at the outlet port of the metering orifice, the outer surface is tapered at an angle of about 45° as is best seen at 24 in FIG. 3. In a practical embodiment of the invention, the inlet to the metering orifice was from 0.093 to 0.095 inches in diameter for a flow of 1.5 gallons per minute and 0.116 for a flow of 2 gallons per minute. The outlet 22 was 0.187 inches and the divergent section 20 was 0.387 inches long and was formed of a radius of 1.5 inches as represented by line 26.

As is shown in FIGS. 1 and 3, the outlet port 22 of the metering nozzle extends into a cylindrical portion 28 of nozzle 12. At the junction between the cylindrical portion of the nozzle and the outlet port of the metering orifice, air holes 30 are provided. As is best seen in FIG. 3, the metering orifice extends into nozzle 12 so that the exit port 22 substantially bisects the air holes 30. Preferably the air holes are four in number and 0.125 inch in diameter. It will be seen that the diameter of the holes is very substantially smaller than outlet port 22, i.e. 0.125 are compared with 0.187 inches in a preferred embodiment. After the air and water pass through the cylindrical portion 28 they enter the divergent section 32 of the nozzle. The outer surface 36 of the nozzle is tapered, as is shown, so that the outlet port 38 has a small rounded circular edge. The divergent section 32 permits entrained air in the water to expand providing the illusion of a full flow of water. Further, the outside taper 36 prevents eddy currents from forming at the outlet port 38 which would cause the nozzle to drip.

In a practical embodiment of the invention, the cylindrical section 28 was 0.625 inches in diameter while the outlet port 38 was 0.875 inches in diameter. The outer surface 36 had a taper of about 20° C. to the long axis of the nozzle.

The outlet port 38 of the nozzle is slightly rounded, it being important that no eddy currents be formed as the water flows out of the nozzle.

Referring now to that embodiment of the invention shown in FIGS. 4–6, many of the parts are the same as those of the previous embodiment so that the same numbers are used. However, instead of the ball 6, one now employs the ball 40 which is held in place with jamb nut 8 with gasket 10 providing a seal. Ball 42 is preferably made of a plastic such as Delrin. Nozzle 12 and the metering orifice 14 are the same as previously described. The latter may be made of plastic.

Valve body 44 has a series of ridges 42 so that it merely snaps into ball 40. The valve body 44 has a transverse opening 46 and the valve plug 48 is mounted in this hole and held in place by retaining ring 50 and sealed with O-rings 52 and 54. The plug 48 is provided with a handle 56 so that it can be easily turned. The opposite end of the valve body is provided with the threads 58 so that it can mounted on the usual supply pipe 60. By turning the handle 56, the user can adjust the pressure as desired or even shut off the flow of water completely without touching the usual shower controls and thus not disturbing the balance between hot and cold. Thus, the head of the present invention is usable over a wide range of inlet pressures. Although a plug valve has been shown, because of its simplicity and ease of operation, other types of valves as are well-known to those skilled in the art might be employed.

I claim:

1. A shower head comprising in combination:

a. a first large chamber forming a plenum for receiving water under pressure, b. a metering orifice providing a single fluid passage leading from said chamber, c. said metering orifice having a cylindrical entrance section smaller in diameter than said first large chamber leading to a gently flared divergent section terminating in an outlet port having a diameter larger than said entrance section, d. a nozzle section forming a continuation of said metering orifice, said nozzle section having a cylindrical portion extending to a divergent section forming a circular discharge port whereby water flows straight through the nozzle section with entrained air in a divergent flare, e. the cylindrical portion of the nozzle section being slightly larger than the outlet port of the metering orifice, f. said nozzle section having an outer surface defining said circular discharge port, g. air entrance ports extending from the outer surface of the nozzle section at right angles to the flow of water through the nozzle section into the confluence of the outlet port of the metering orifice and the cylindrical portion of the nozzle section.

2. The shower head of claim 1 wherein the metering orifice is threadably mounted in the nozzle section whereby it can be replaced and wherein the outlet port of said orifice is located at about the center of the air entrance ports.

3. A shower head in accordance with claim 1 having the following dimensions in inches:

a. diameter of cylindrical entrance section of metering orifice: 0.093 to 0.116, b. diameter of outlet port of metering orifice: 0.187, c. length of divergent section: 0.387, d. diameter of air entrance ports: 0.125, e. diameter of cylindrical portion of nozzle section: 0.625, f. diameter of discharge port of nozzle section: 0.875.

4. The shower head of claim 1 wherein said first chamber is provided with a valve whereby the amount of water flowing through the first chamber can be controlled.

5. The shower head of claim 4 wherein said valve is a rotating plug valve.

* * * * *